US012428782B2

(12) United States Patent
Parnaudeau et al.

(10) Patent No.: US 12,428,782 B2
(45) Date of Patent: Sep. 30, 2025

(54) METHOD FOR MANUFACTURING A STROP

(71) Applicant: POLYACHT, Tahiti (PF)

(72) Inventors: Benoit Parnaudeau, Tahiti (PF); Christophe Monnier, Tahiti (PF)

(73) Assignee: POLYACHT, Tahiti (FR)

( * ) Notice: Subject to any disclaimer, the term of this patent is extended or adjusted under 35 U.S.C. 154(b) by 0 days.

(21) Appl. No.: 18/836,336

(22) PCT Filed: Feb. 17, 2023

(86) PCT No.: PCT/IB2023/051445
§ 371 (c)(1),
(2) Date: Aug. 6, 2024

(87) PCT Pub. No.: WO2023/156952
PCT Pub. Date: Aug. 24, 2023

(65) Prior Publication Data

US 2025/0154718 A1 May 15, 2025

(30) Foreign Application Priority Data

Feb. 18, 2022 (FR) ..... 2201445

(51) Int. Cl.
*D07B 7/16* (2006.01)
*D07B 7/02* (2006.01)
*D07B 1/18* (2006.01)

(52) U.S. Cl.
CPC ..... *D07B 7/165* (2013.01); *D07B 7/027* (2013.01); *D07B 1/185* (2013.01)

(58) Field of Classification Search
CPC .. B66C 1/12; D07B 1/18; D07B 1/185; D07B 5/04; D07B 7/027; D07B 7/165;
(Continued)

(56) References Cited

U.S. PATENT DOCUMENTS 758,286 A * 4/1904 Warner ..... D04C 1/06 87/9
3,056,706 A * 10/1962 Knoppel ..... B29C 70/20 156/169

(Continued)

FOREIGN PATENT DOCUMENTS

CN 110552218 A 12/2019
DE 2716056 A1 10/1978

(Continued)

OTHER PUBLICATIONS

Translation of IT-1036098.*

(Continued)

*Primary Examiner* — Shaun R Hurley
(74) *Attorney, Agent, or Firm* — Helene Laville; HEFIP, LLC

(57) ABSTRACT

A method for manufacturing a strop (10) including a first eyelet (12*a*), a second eyelet (12*b*) and a slender central body (14). The strop comprises a core (16) surrounded by a tubular sheath (18) having a first stub (22*a*), a first hole (24*a*), a first inter-hole portion (26*a*), a second hole (28*a*), a central section (30), a third hole (28*b*), a second inter-hole portion (26*b*), a fourth hole (24*b*) and a second stub (22*b*). The method comprises a first priming step of fitting a belt (32) into the sheath (18), to form-a closed ring projecting from the first and second hole (24*a*, 28*a*) to create the first eyelet (12*a*) and projecting from the third and fourth hole (28*b*, 24*b*) to create the second eyelet (12*b*), a second connection step of connecting a reel (36) on the belt (32), and a third step of filling the sheath (18) driving the belt in rotation.

9 Claims, 4 Drawing Sheets

(58) Field of Classification Search
CPC .... D07B 2201/2052; D07B 2201/2083; D07B 2201/207; F16G 11/146
USPC ..... 57/21, 201
See application file for complete search history.

(56) References Cited

U.S. PATENT DOCUMENTS

| | | | | | |
|---|---|---|---|---|---|
| 4,093,292 | A * | 6/1978 | Marcet | B66C 1/12 294/74 |
| 4,843,807 | A * | 7/1989 | von Danwitz | D07B 7/165 87/8 |
| 2016/0305065 | A1 * | 10/2016 | Brancaleoni | D07B 1/18 |

FOREIGN PATENT DOCUMENTS

| | | | | | |
|---|---|---|---|---|---|
| EP | 0487805 | A1 | | 6/1992 | |
| IT | 1036098 | B | * | 10/1979 | B66C 1/12 |
| JP | 2000177977 | A | | 6/2000 | |
| JP | 2000239983 | A | * | 9/2000 | D07B 1/18 |
| KR | 20130102768 | A | * | 9/2013 | |
| NL | 2017779 | B1 | * | 5/2018 | |
| WO | WO-2021007497 | A1 | * | 1/2021 | B66C 1/22 |

OTHER PUBLICATIONS

Translation of KR-20130102768.*
Translation of JP-2000239983.*
Translation of the International Search Report (2 pages).
Translation of the Written Opinion (6 pages).

* cited by examiner

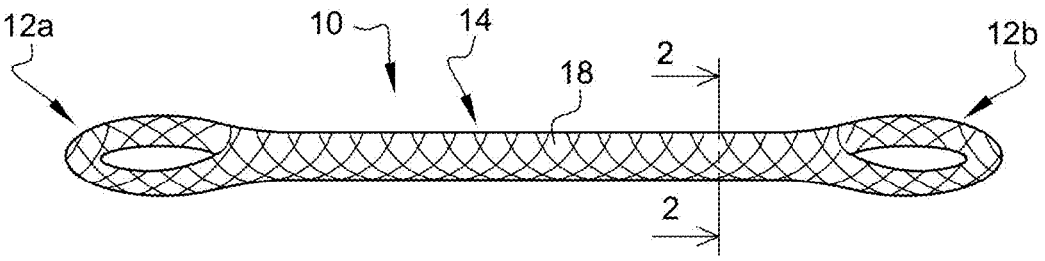
Fig. 1
Fig. 2
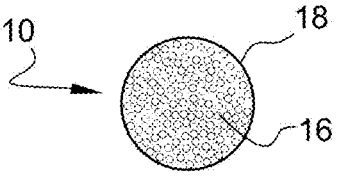
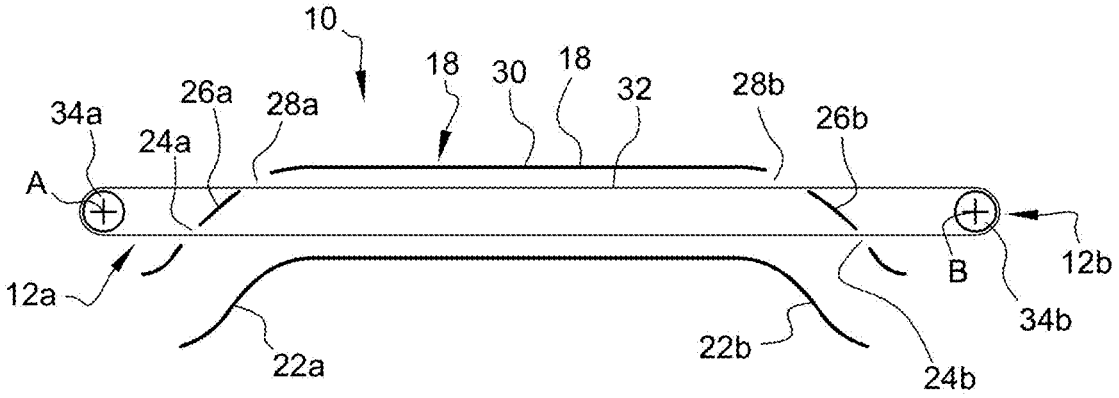
Fig. 3

METHOD FOR MANUFACTURING A STROP

FIELD OF THE INVENTION

The present patent application relates to a method for manufacturing a strop.

By "strop", it should be understood a cable which includes a first eyelet, a second eyelet and a slender central body which extends from the first eyelet up to the second eyelet, the strop comprising a central core which is surrounded by a protective tubular sheath.

The present invention will find advantageous, yet non-limiting, applications in the marine and boating fields, in particular for equipping sailboats to make guy ropes, straps, textile shackles and lifeline, for example.

PRIOR ART

A first type of a method for manufacturing a strop with two eyelets is known, which comprises a first step of winding a wire between two fixed points to form a ring.

The wire is wrapped over several turns around the two fixed points, each new turn increasing the mechanical strength of the strop.

Also, it is possible to adjust the length of the ring formed by winding the wire, and therefore of the final strop, by tuning the axis spacing of the two fixed points.

The ring obtained following the first winding step is homogeneously held by an adhesive tape.

Then, during a second sheathing step, the ring is inserted into a tubular sheath so that the ring has two ends each projecting from the sheath, these two ends forming the two eyelets of the strop.

This first method type includes a third step which consists in protecting the two eyelets of the strop, for example by means of an additional sheath.

Such a method for manufacturing a strop does not enable a satisfactory finishing of both eyelets.

Indeed, the protective sheath of the two eyelets should be connected on the main sheath of the strop, such a connection might alter the homogeneity of the strength of the wire beam that forms the core of the strop.

A second type of a method for manufacturing a strop is known wherein the sheath successively has, from one end to another, a first stub, a first hole, a first inter-hole portion, a second hole, a central section, a third hole, a second inter-hole portion, a fourth hole and a second stub.

By "stub", it should be understood a free end section of the sheath.

This second method type includes a first filling step which consists in manually fitting a wire into the sheath to form the core of the strop, so that the wire creates a ring which partially extends inside the sheath, which comes out of the first hole and the second hole of the sheath to for the first eyelet, and which comes out of the third hole and the fourth hole of the sheath to form the second eyelet.

For example, the first step consists successively in handling the wire so that the wire fits into the sheath through the third hole, comes out through the second hole, fits in through the first hole and then comes out through the fourth hole.

The first step is repeated several times to increase the number of turns formed by the wire, each new turn increasing the mechanical strength of the strop.

Also, the second method type according to the prior art comprises a second finishing step which comprises a first phase consisting in inserting the free end of the first stub into the sheath through the second hole to cover the core of the first eyelet with the first inter-hole portion of the sheath, and a second phase consisting in inserting the free end of the second stub into the sheath through the third hole to cover the core of the second eyelet with the second inter-hole portion of the sheath.

This second method type allows obtaining a neat finish of the strop whose unique sheath covers the two eyelets and the slender central body of the strop at the same time.

However, carrying out this second method type manually results in high production costs which restrict this strop type to competition sailboating or to luxury sailboats.

DISCLOSURE OF THE INVENTION

In particular, the present invention aims to solve the drawbacks of the aforementioned prior art by providing a method for manufacturing a strop which allows making a strop having a single-sheath neat finish and a reduced manufacturing cost.

This objective, as well as others which will appear upon reading the following description, are achieved with a method for manufacturing a strop which includes a first eyelet, a second eyelet and a slender central body which extends from the first eyelet up to the second eyelet, the strop comprising a core surrounded by a protective tubular sheath which successively has a first stub, a first hole, a first inter-hole portion, a second hole, a central section, a third hole, a second inter-hole portion, a fourth hole and a second stub, which method is characterised in that it comprises at least:

- a first priming step which consists in fitting a belt into the sheath, so that the belt forms a closed ring which projects from the first hole and from the second hole of the sheath to create the first eyelet, and which projects from the third hole and from the fourth hole of the sheath to create the second eyelet,
- a second connection step which consists in connecting a reel of a wire on the belt by means of an attachment, and
- a third step of filling the sheath which consists in driving the belt in rotation to unwind the wire reel or form the core of the strop.

Thus, the method according to the invention allows multiplying the number of wire turns which make up the core of the strop, by simply driving in rotation the belt fitted into the sheath during the first priming step.

According to other optional features of the invention, considered separately or in combination:

- at the end of the third filling step, the wire that is connected on the reel is cut and the attachment which connects the wire on the reel is detached, so that the wire which forms the core of the strop has two ends which are free, these two free ends being connected together by a new attachment;
- the method includes a fourth finishing step, which is carried out following the third step, and which comprises a first phase consisting in inserting the free end of the first stub into the sheath through the second hole to cover the core of the first eyelet by the first inter-hole portion of the sheath, and a second phase consisting in inserting the free end of the second stub into the sheath through the third hole to cover the core of the second eyelet by the second inter-hole portion of the sheath. This step allows covering the two eyelets of the strop with the same sheath which covers the body of the strop, and closing the sheath;

the fourth finishing step includes a third phase which consists in making the first stub come out of the sheath beyond the second hole and in cutting the portion of the first stub which projects from the sheath, and a fourth phase which consists in making the second stub come out of the sheath beyond the third hole and in cutting the portion of the second stub which projects from the sheath;

the belt is tensioned between a first rotating element which extends through the first eyelet and a second rotating element which extends through the second eyelet, at least one amongst the two rotating elements being a driver rotating element adapted to drive the belt in rotation during the third step of the method. This feature of the method allows driving the belt mechanically, in particular by means of a motor-driven rotating element, to increase the number of wire turns that form the core of the strop;

the axis spacing between the first rotating element and the second rotating element is adjustable to allow adjusting the length of the strop;

the belt is formed by said wire which is connected on itself;

the wire that forms the core of the strop is made of a continuous fibre;

the wire that forms the core of the strop is composed of a plurality of threads which form a strand;

the wire that forms the core of the strop is composed of a plurality of threads which form a braid.

BRIEF DESCRIPTION OF THE DRAWINGS

Other features and advantages of the invention will appear better upon reading the following description, with reference to the appended figures, which illustrate:

FIG. 1: a perspective front view of a strop made by the manufacturing method according to the invention;

FIG. 2: a sectional view of the strop of FIG. 1, according to the axis 2-2 of FIG. 1, which comprises a peripheral sheath and a core;

FIG. 3: a schematic top view of the strop during the first priming step of the method according to the invention;

In all these figures, identical or similar elements bear identical or similar reference signs.

DETAILED DESCRIPTION OF EMBODIMENTS OF THE INVENTION

Figure 4:
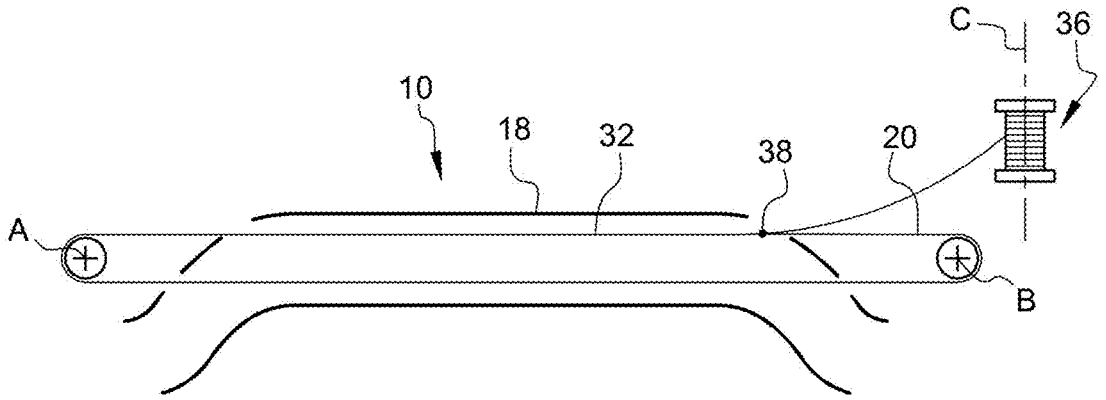
FIG. 4: a schematic top view of the strop during the second connection step of the method according to the invention.

The invention relates to a method for manufacturing a strop 10 as shown in FIG. 1.

The strop 10 includes a first eyelet 12*a*, a second eyelet 12*b* and a slender central body 14 which extends longitudinally from the first eyelet 12*a* up to the second eyelet 12*b*.

It should be noted that the strop 10 has a radial midplane of symmetry.

As shown in FIG. 2, the strop 10 comprises an inner core 16 which is surrounded by a protective tubular sheath 18.

The core 16 of the strop 10 is formed by a plurality of yarns of a wire 20.

The term "wire" refers to both a wire formed by a continuous fibre of a synthetic or natural material, or a strand, or a braid formed by a plurality of threads, or a chain or any other link type.

According to a preferred example of implementation of the invention, the wire 20 is made from a polyethylene fibre, like the fibre known by the commercial name Dyneema®.

The sheath 18 successively has, from the left to the right in FIG. 3, a first stub 22*a*, a first hole 24*a*, a first inter-hole portion 26*a*, a second hole 28*a*, a central section 30, a third hole 28*b*, a second inter-hole portion 26*b*, a fourth hole 24*b* and a second stub 22*b*.

By "stub", it should be understood a free end section of the sheath 18 which remains free following the first priming step, as described later on.

Referring to FIG. 3, the manufacturing method according to the invention comprises a first priming step.

The first priming step consists in fitting a drive belt 32 into the sheath 18, so that the belt 32 forms a closed ring which comes out of the first hole 24*a* and the second hole 28*a* of the sheath 18 to create the first eyelet 12*a*, and which comes out of the third hole 28*b* and the fourth hole 24*b* of the sheath 18 to create the second eyelet 12*b*.

Still with reference to FIG. 3, the belt 32 is tensioned between a first rotating element 34*a* which extends through the first eyelet 12*a*, according to a first axis A of rotation, and a second rotating element 34*b* which extends through the second eyelet 12*b*, according to a second axis B of rotation.

It should be noted that the longitudinal axis spacing between the first rotating element 34*a* and the second rotating element 34*b* is adjustable to allow adjusting the length of the strop 10.

To this end, the belt 32 is formed by a link which is handled so that, successively, it fits into the sheath 18 through the third hole 28, comes out through the second hole 28*a*, wraps around the first rotating element 34*a*, fits again into the sheath 18 through the first hole 24*a*, comes out of the sheath 18 through the fourth hole 24*b* and then wraps around the second rotating element 34*b*.

The first priming step may be carried out by means of a needle (not shown) which allows driving the belt 32 manually through the sheath 18 as described before.

Once the belt 32 has been fitted into the sheath 18, the belt 32 is closed on itself, for example by a knot or a splice or any other connection type.

Referring to FIG. 4, the method according to the invention includes a second connection step which is carried out following the first priming step and which consists in connecting a wire 20 reel 36 on the belt 32 by means of an attachment 38.

The reel 36 is rotatably mounted on its axis C so as to be unwound when the wire 20 is pulled.

Without limitation, the reel 36 may be mounted on a motor-driven shaft to promote unwinding thereof, and the reel 36 may also be associated with a brake which imparts a tension on the wire 20.

The attachment 38 may be formed by a knot, a splice, a glue spot, an adhesive tape or any other connection type.

Figure 5:
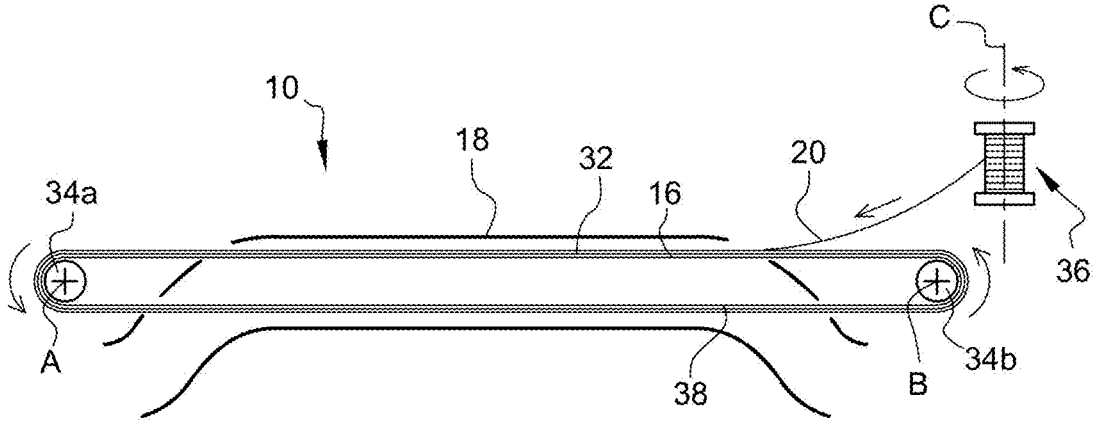
FIG. 5: a schematic top view of the strop during the third filling step of the method according to the invention.
Figure 6:
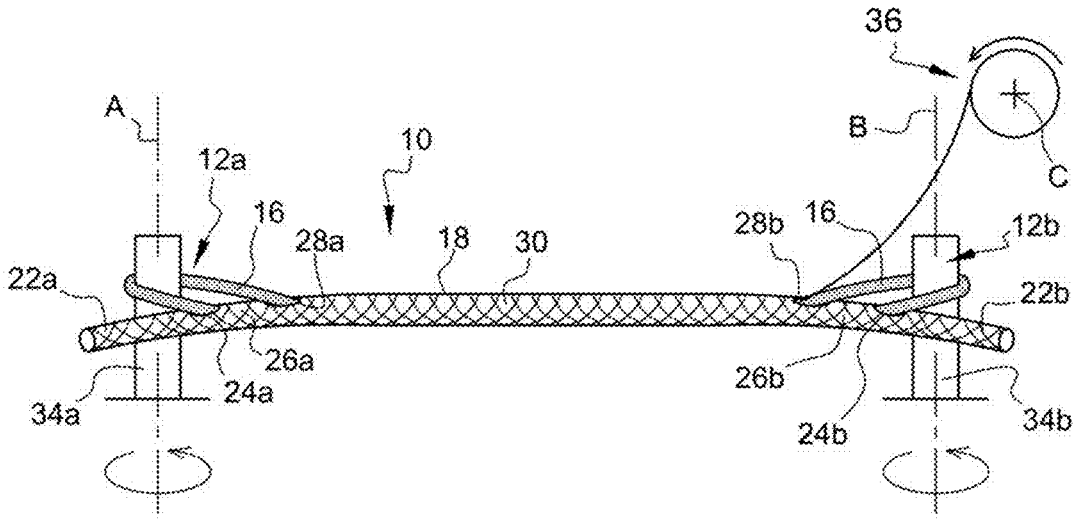
FIG. 6: a perspective front view of the strop during the third filling step of the method according to the invention.

The second connection step of the method is followed by a third step of filling the sheath 18, which consists in driving the belt 32 in rotation about the first rotating element 34*a* and the second rotating element 34*b*, to unwind the wire 20 reel 36 and form the core 16 of the strop 10, as shown in FIGS. 5 and 6.

To this end, the first rotating element 34*a* is a driver rotating element which is adapted to drive the belt 32 in rotation.

Preferably, the first rotating element 34*a* is driven in rotation, for example, by an electric motor (not shown).

Each revolution performed by the belt 32 increases by two strands the core 16 of the central body 14 of the strop 10 and by one strand the core 16 of the first eyelet 12*a* and of the second eyelet 12*b*.

Thus, each new revolution of the belt 32 increases the mechanical strength of the strop 10.

Figure 7:
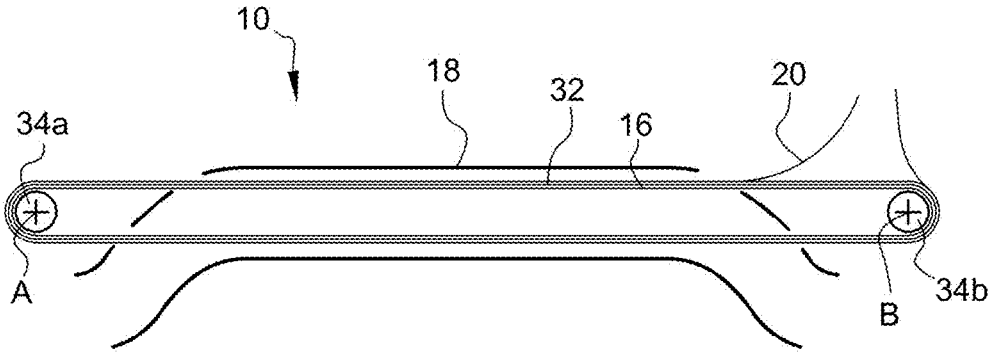
FIG. 7: a schematic top view of the strop during the third filling step of the method according to the invention, where the portion of the wire that is connected on the reel is cut.

At the end of the third filling step, with reference to FIG. 7, the portion of the wire 20 which is connected on the reel 36 is cut and the attachment 38 which connects the wire 20 on the belt 32 is detached, so that the wire 20 that forms the core 16 of the strop 10 has two ends which are free.

Figure 8:
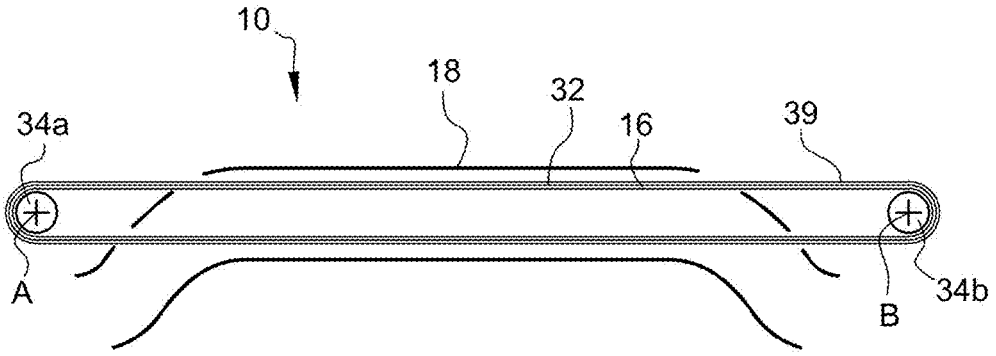
FIG. 8: a schematic top view of the strop during the third filling step of the method according to the invention, where the two free ends of the wire are connected together by a new attachment.

These two free ends are connected together by a new attachment 39 illustrated in FIG. 8, to close the wire 20 loop which forms the core 16 of the strop 10.

The new attachment 39 may be formed by a knot, a splice, a glue spot, an adhesive tape or any other connection means.

Also, still during the third filling step, the belt 32, which is cleared off the wire 20, is removed from the sheath 18 so as to keep only the core 16 formed by the wire 20 in the sheath 18.

Also, the method includes a fourth finishing step which is carried out following the third filling step and which consists in covering the core 16 of the first eyelet 12*a* and of the second eyelet 12*b* with the sheath 18.

Figure 9:
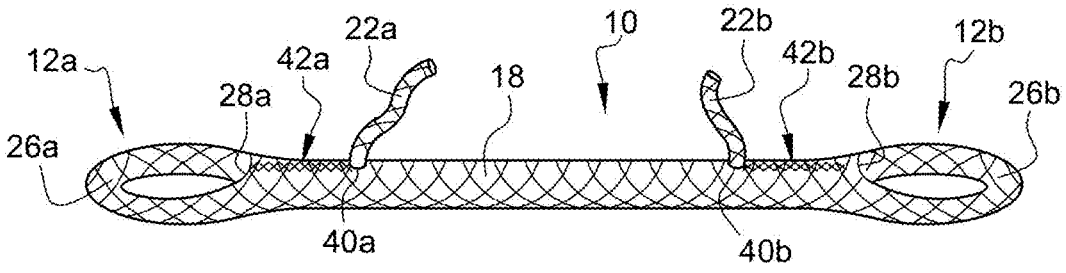
FIG. 9: a perspective front view of the strop during the fourth finishing step of the method according to the invention.

For this purpose, with reference to FIG. 9, the fourth finishing step comprises a first phase which consists in inserting the free end of the first stub 22*a* into the sheath 18 through the second hole 28*a* of the sheath 18 to cover the core 16 of the first eyelet 12*a* by the first inter-hole portion 26*a* of the sheath 18.

The first stub 22*a* comes out of the sheath 18 through a first exit orifice 40*a* of the sheath 18 which is located beyond the second hole 28*a*, and then the end of the first stub 22*a* that projects from the sheath 18 is cut.

Similarly, the fourth finishing step comprises a second phase which consists in inserting the free end of the second stub 22*b* into the sheath 18 through the third hole 28*b* of the sheath 18 to cover the core 16 of the second eyelet 12*b* by the second inter-hole portion 26*b* of the sheath 18.

The second stub 22*b* comes out of the sheath 18 through a second exit orifice 40*b* of the sheath 18 which is located beyond the third hole 28*b*, and then the end of the second stub 22*b* that projects from the sheath 18 is cut.

In order to prevent the sheath 18 from slipping on the core 16 of the strop 10, the fourth finishing step includes a third sewing phase which consists in carrying out a first sewing 42*a*, or an equivalent blocking means, between the second hole 28*a* and the first orifice 40*a* of the sheath 18.

Similarly, the third sewing phase consists in carrying out a second sewing 42*b*, or an equivalent blocking means, between the third hole 28*b* and the second orifice 40*b* of the sheath 18.

Thus, following the fourth finishing step, the method according to the invention allows obtaining a strop 10 such as that one shown in FIG. 1, with a sheath 18 which is entirely closed.

Figure 10:
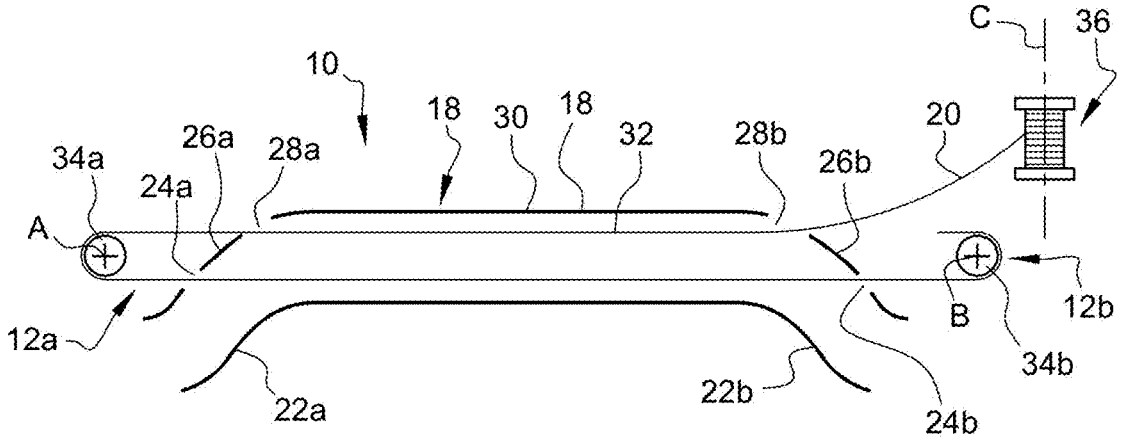
FIG. 10: a schematic top view of the strop during the first priming step of the method according to a variant of the invention where the belt is closed by the wire which forms the core of the strop.
Figure 11:
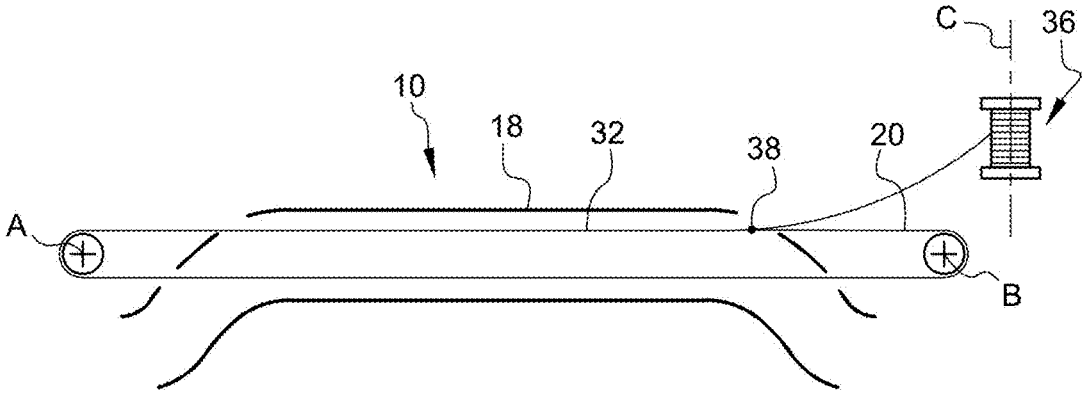
FIG. 11: a schematic top view of the strop during the second connection step of the method according to the variant of the invention of FIG. 10.

According to a variant of the invention illustrated in FIGS. 10 and 11, the belt 32 is formed directly by the wire 20 of the reel 36 which is intended to form the core 16 of the strop 10.

Thus, according to this variant of the method, the first priming step consists in handling a free end of the wire 20 so that, successively, the wire 20 fits into the sheath 18 through the third hole 28*b*, comes out through the second hole 28*a*, wraps around the first rotating element 34*a*, fits again into the sheath 18 through the first hole 24*a*, comes out of the sheath 18 through the fourth hole 24*b* and then wraps around the second rotating element 34*b*.

Once the wire 20 has been inserted into the sheath 18, the wire 20 is closed on itself by an attachment 38 to form the belt 32, as shown in FIG. 11.

It should be understood that, according to this variant, the second connection step which consists in connecting a wire 20 reel 36 on the belt 32 is no longer necessary.

Finally, this variant includes a third step of filling the sheath 18 and a fourth finishing step which are identical to the third step and to the fourth step described before.

In particular, the method according to the invention allows mechanising the third step of filling the sheath 18 to form the core of the strop 10, which allows considerably reducing the manufacturing time in comparison with a method wherein the filling step is carried out manually.

Indeed, filling the sheath 18 is carried out by driving the belt 32, this driving could be motorised and automated.

Thus, the method according to the invention allows reducing the human intervention duration.

In addition, the method according to the invention allows carrying out the manufacture of a strop 10 of the previously-described type on an industrial scale.

Of course, the invention is described in the foregoing as example. It should be understood that a person skilled in the art is capable of carrying out different variants of the invention yet without departing from the scope of the invention.

The invention claimed is:

1. A method for manufacturing a strop (10) which includes a first eyelet (12*a*), a second eyelet (12*b*) and a slender central body (14) which extends from the first eyelet (12*a*) up to the second eyelet (12*b*), the strop (10) comprising a core (16) surrounded by a protective tubular sheath (18) which successively has a first stub (22*a*), a first hole (24*a*), a first inter-hole portion (26*a*), a second hole (28*a*), a central section (30), a third hole (28*b*), a second inter-hole portion (26*b*), a fourth hole (24*b*) and a second stub (22*b*), which method comprising at least:

a first priming step which consists in fitting a belt (32) or a wire (20) respectively into the sheath (18), so that the belt (32) or the wire (20) respectively forms a closed ring which projects from the first hole (24*a*) and from the second hole (28*a*) of the sheath (18) to create the first eyelet (12*a*), and which projects from the third hole (28*b*) and from the fourth hole (24*b*) of the sheath (18) to create the second eyelet (12*b*), a second connection step which respectively consists in connecting a reel (36) of a wire (20) on the belt (32) by means of an attachment (38), or in closing the wire (20) on itself by means of an attachment (38), and a third step of filling the sheath (18) which respectively consists in driving the belt (32) in rotation to unwind the wire (20) reel (36) or said wire (20) to form the core (16) of the strop (10).

2. The method for manufacturing a strop (10) according to claim 1, wherein at the end of the third filling step, the wire (20) that connected on the reel (36) is cut and the attachment (38) which connects the wire (20) on the reel (32) is detached, so that the wire (20) which forms the core (16) of the strop (10) has two ends which are free, these two free ends being connected together by a new attachment (39).

3. The method for manufacturing a strop (10) according to claim 1, wherein it includes a fourth finishing step, which is carried out following the third filling step, and which comprises a first phase consisting in inserting the free end of the first stub (22*a*) into the sheath (18) through the second hole (28*a*) to cover the core of the first eyelet (12*a*) by the first inter-hole portion (26*a*) of the sheath (18), and a second phase consisting in inserting the free end of the second stub (22*b*) into the sheath (18) through the third hole (28*b*) to cover the core of the second eyelet (12*b*) by the second inter-hole portion (26*b*) of the sheath (18).

4. The method for manufacturing a strop (10) according to claim 3, wherein the fourth finishing step includes a third phase which consists in making the first stub (22*a*) come out of the sheath (18) beyond the second hole (28*a*) and in cutting the portion of the first stub (22*a*) which projects from the sheath (18), and a fourth phase which consists in making the second stub (22*b*) come out of the sheath (18) beyond the third hole (28*b*) and in cutting the portion of the second stub (22*b*) which projects from the sheath (18).

5. The method for manufacturing a strop (10) according to claim 1, wherein the belt (32) is tensioned between a first rotating element (34*a*) which extends through the first eyelet (12*a*) and a second rotating element (34*b*) which extends through the second eyelet (12*b*), at least one amongst the two rotating elements (34*a*, 34*b*) being a driver rotating element adapted to drive the belt (32) in rotation during the third filling step of the method.

6. The method for manufacturing a strop (10) according to claim 5, wherein an axis spacing between the first rotating element (34*a*) and the second rotating element (34*b*) is adjustable to allow adjusting the length of the strop (10).

7. The method for manufacturing a strop (10) according to claim 1, wherein the wire (20) that forms the core (16) of the strop (10) is made of a continuous fibre.

8. The method for manufacturing a strop (10) according to claim 1, wherein the wire (20) that forms the core (16) of the strop (10) is composed of a plurality of threads which form a strand.

9. The method for manufacturing a strop according to claim 1, wherein the wire (20) that forms the core (16) of the strop (10) is composed of a plurality of threads which form a braid.

* * * * *